United States Patent [19]

Koizumi et al.

[11] 4,020,665

[45] May 3, 1977

[54] DEVICE FOR HOLDING RAW MATERIAL IN A CROSS-ROLLING MACHINE

[75] Inventors: Mokuji Koizumi; Yukitsugu Kobayashi, both of Hiroshima, Japan

[73] Assignee: Mitsubishi Jukogyo Kabushiki Kaisha, Tokyo, Japan

[22] Filed: Nov. 28, 1975

[21] Appl. No.: 635,782

[30] Foreign Application Priority Data

Jan. 10, 1975 Japan ..... 50-5390[U]

[52] U.S. Cl. ..... 72/108; 72/125; 72/250

[51] Int. Cl.[2] ..... B21B 39/02; B21D 13/04

[58] Field of Search ..... 72/108, 121, 125, 123, 72/250

[56] References Cited

UNITED STATES PATENTS 2,099,497 11/1937 Offutt ..... 72/100

*Primary Examiner*—Willie G. Abercrombie

*Attorney, Agent, or Firm*—Cushman, Darby & Cushman

[57] ABSTRACT

A cross-rolling machine including a device for holding a workpiece between the rolls during a forming operation, the device comprising a pair of guide boards each mounted on a frame assembly including a guide bar, so as to be arranged one on each side of the workpiece when the machine is in use, each guide board being movable from the machine frame integrally with its frame assembly by sliding movement of the guide bar along a guide track on the machine frame.

7 Claims, 6 Drawing Figures

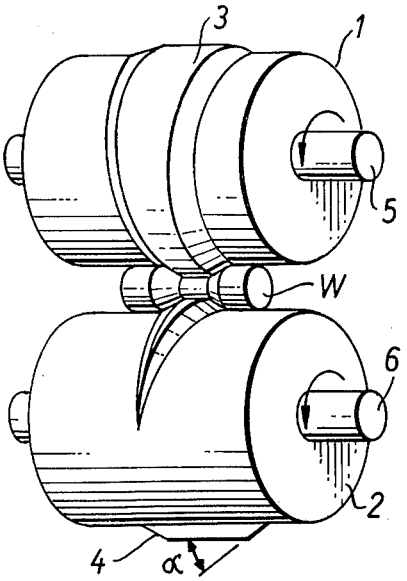
-FIG. 1.-
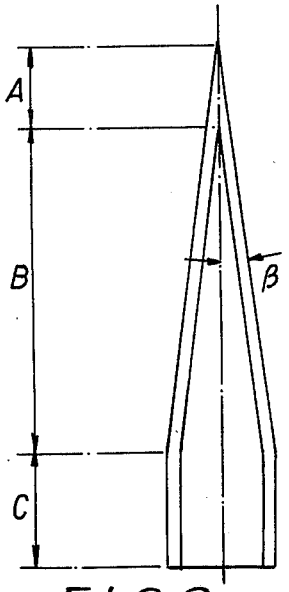
-FIG. 2.-
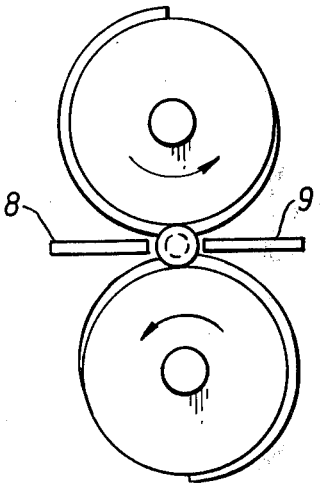
-FIG. 3.-
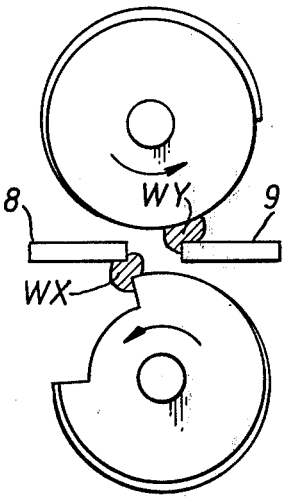
-FIG. 6.-

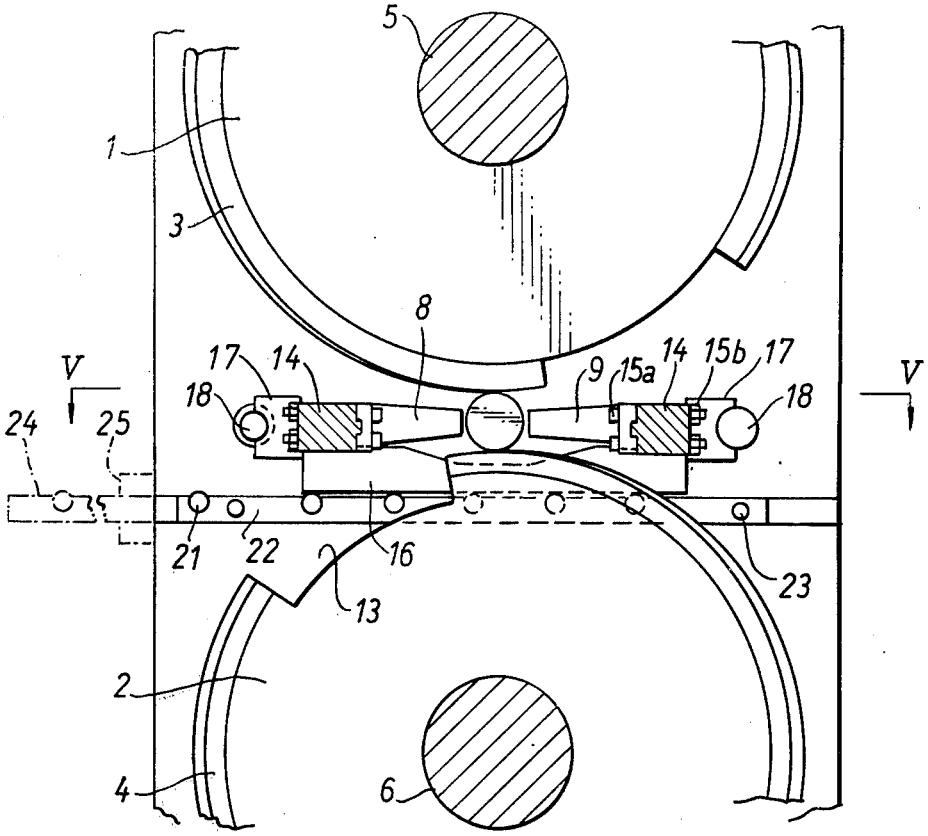
—FIG. 4.—

DEVICE FOR HOLDING RAW MATERIAL IN A CROSS-ROLLING MACHINE

This invention relates to a cross rolling machine incorporating a device for holding raw material between the rolls thereof.

In cross rolling machines a pair of parallel rolls each carrying a forming die are rotated in the same direction and at the same speed to roll form a piece of material placed between the rolls. In order to retain the workpiece in position guide boards are arranged between the rolls engaging the sides of the workpiece along lines parallel to the roll axes. (see FIGS. 1 to 3 of the accompanying drawings.)

In one machine known to us in Japan the guide boards are bolted respectively to right and left hand guide board mounting plates. In the case of a small size cross-rolling machine, however, guide boards in the form of integrally constructed blocks may be directly secured to the main frames of the machine without using the mounting plates. Because the guide boards are often large and heavy they are commonly formed in a two part construction.

The guide board mounting plates are firmly secured to the frames of the machine so as to take up the pressure force applied to the guide board surfaces by the material force applied to the guide board surfaces by the material during the rolling forming operation. The mounting plates and guide boards are further reinforced by channel-shaped stoppers which embrace the mounting plates and by means of which the mounting plates are fixed to the frames.

Each time the size of the material which is to be subjected to the forming operation is changed, the forming dies and the guide boards therefor must also be changed. However, the interchanging operation of the guide boards is very troublesome and requires skill in operation, because the operation must be carried out in the narrow space existing between the upper and lower rolls. Further, in carrying out the change of guide boards, added difficulty is experienced if a driving device is located adjacent to either one of left and right guide board mounting plates. Under some conditions, the interchange and adjustment of both the guide boards must be effected from one side of the machine thereby making the operation more difficult which results in prolongation of the time required for the interchange of the forming dies and the preparation and adjustment thereof.

In some cases, cooling fluid is applied to the forming dies during the rolling forming operation and, when the machine is used for a long time, erosion of parts of the machine due to generation of rust becomes serious so that interchange of guide boards, mounting plates, stoppers, bolts, etc. is required. However, since they are heavy parts, the interchange and adjustment thereof are difficult.

Further, as shown in FIG. 6 of the accompanying drawings, portions Wx, Wy of forming product or raw material sometimes get jammed between the forming dies and the guide boards. In such a case, the jamming can not be relieved unless guide boards are disassembled. Further, the guide boards might be deformed during the forming operation. As a result of all these factors, the guide boards must frequently be disassembled, thereby requiring much labour.

According to the present invention there is provided a cross rolling machine including a device for holding a workpiece between the rolls during a forming operation, the device comprising a pair of guide boards each mounted on a frame assembly including a guide bar, so as to be arranged one on each side of the workpiece when the machine is in use, each guide board being movable from the machine frame integrally with its frame assembly by sliding movement of the guide bar along a guide track on the machine frame. Advantageously the two boards are supported by a single frame assembly.

A machine in accordance with the invention will now be described by way of example with reference to the accompanying drawings, in which:

FIGS. 1 to 3 illustrate the method of cross-rolling, FIG. 1 being a perspective view of the rolls of a cross-rolling machine, FIG. 2 showing the leading angle of a forming die of the machine and FIG. 3 being a diagrammatic illustration of an end view of the rolls of FIG. 1;

FIG. 4 is an end view of a cross-rolling machine in accordance with the invention;

FIG. 6 illustrates jamming of a cross-rolling machine during a rolling forming operation.

Figure 5:
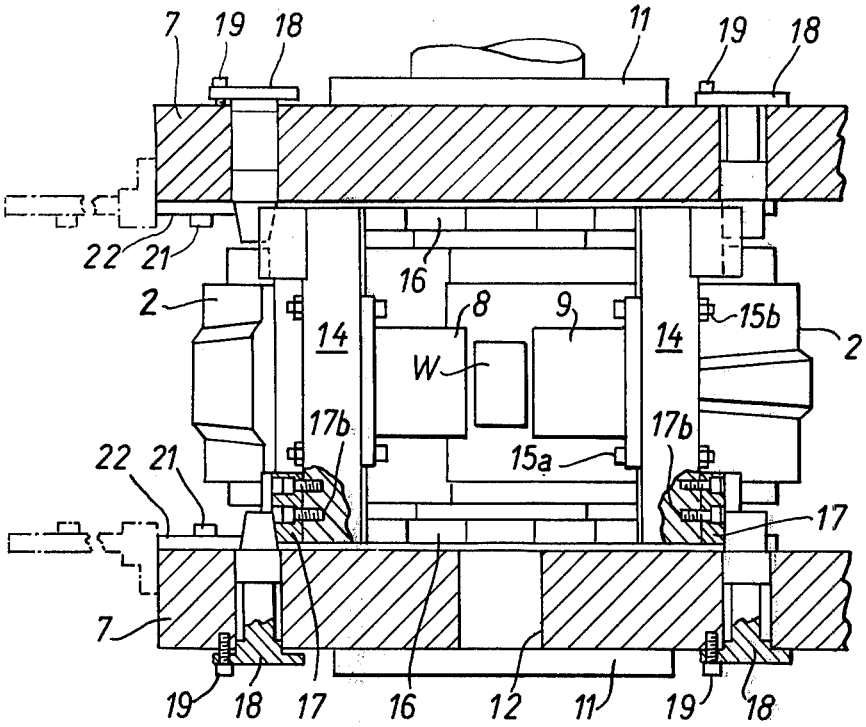
FIG. 5 is a sectional view taken on the line V—V of the machine of FIG. 4.

In a cross-rolling machine, shown in FIGS. 1 to 3 of the accompanying drawings, forming dies 3, 4 are attached to the outer peripheries one to each of a pair of rolls 1, 2 supported in mutually parallel relationship by means of respective roll shafts 5, 6 which are journalled in bearings in main side frames which support the rolls. A raw material workpiece W to be formed is inserted between the rolls 1, 2 parallel to the roll shafts 5, 6, and, when the upper and lower rolls 1, 2 are driven to rotate in the same direction at the same speed, the raw material W located between the rolls 1, 2 is forcibly rotated by the forming dies 3, 4 so that a rolling forming operation is effected. In this case, the rolling forming operation is completed by one revolution of the rolls. The angle $\alpha$ shown in FIG. 1 is the wedge angle of the forming die and the angle $\beta$ shown in FIG. 2 is the advance angle of the forming die. In FIG. 2, A is the bite angle, B is the widening forming portion, and C is the finishing forming portion of the forming dies.

In order to define and maintain the position of the material W between the upper and lower rolls 1, 2 during a rolling forming operation so as to prevent it from being moved out of the rolls, guide boards 8, 9 are provided as shown in FIG. 3.

As can be seen from FIGS. 4 and 5, in a machine according to the invention the rolls 1 and 2 are supported on main side frames 7 through bearings 11. Material to be formed is inserted through a hole 12 in the frame 7, and formed material is removed through a groove 13 in the roll 2. In this embodiment the guide boards 8 and 9 are each mounted at the center of a respective guide board mounting plate 14, by means of bolts 15*a* and nuts 15*b*, in symmetrical relationship to one another as shown in FIGS. 4 and 5. The guide board mounting plates 14 are each securely attached at their ends to a respective pair of guide bars 16. A respective block 17 is attached to each of the outer ends of each mounting plate by bolts 17*b*, the blocks each being recessed to receive a respective stopper or fixing pin 18 which passes through a hold in the side frame from the outside to engage the recess to locate and retain the guide boards in position. The fixing pins 18 are held in position by bolts 19 which screw into the frame 7.

The mounting plates 14, guide bars 16 and blocks 17 for both guide boards form respective integral assemblies which in this embodiment are joined together by common guide bars 16 to form a single integral frame assembly which is movable, on release of one pair of the fixing pins 18, away from the forming area by sliding movement of the guide bars 16 in either direction parallel to the side frames on rollers 21. The rollers 21 are rotatably attached to the inner surfaces of brackets 22 which are secured to the inside surfaces of both the side frames by bolts 23 so that the upper surfaces lie in the same horizontal plane and form guide tracks for the guide bars 16. The uppermost points of the outer peripheries of the rolls 21 lie in the same horizontal plane, which plane is a little higher than that containing the upper surfaces of the brackets 22.

As shown by two dot-chain line in FIG. 5, when brackets 24 are added, supported by supports 25 (secured to frames 7) so as to provide extensions, guide board mounting stands 14 can be easily removed from the machine. The shape of the tip of each of the pins 18, usually made so as to have circular or polygonal cross-section and blocks 17 are abutted to the pins so as to engage only one side thereof. (See FIG. 4).

Further, by making the shape of the tip and recess of each of either of the pairs of pins 18 in a co-operating tapered form (the left hand pin in this example) and by urging the pins against the guide board mounting plates 14 from both sides thereof, the positioning and the supporting of the guide board mounting plates is made more exact and firm, and it is also possibile to urge slightly the guide board mounting plates upwardly by the tapered portions of the pins. With this arrangement, the lower surfaces of guide bars 16 move away from rollers 21 so that the working force exerted on the guide bars during the rolling forming operation will not be directly applied to rollers 21 thereby affording a prolonged life of the rollers 21.

When a raw material W is subjected to rolling forming operation by using a cross-rolling machine in accordance with the present embodiment, the rolling forming operation is effected in a similar manner to the prior art operation. However, when changing over guide boards 8, 9, guide board mounting plates 14 or other parts of the holding device, the whole frame assembly can be easily withdrawn from the machine in either the leftward or the rightward direction as shown in the drawings merely by withdrawing the relevant pair of pins 18.

A machine so constructed not only provides extremely easy interchanging operation of the guide boards in comparison with the prior art machine, but also makes possible location of a driving device for the rolls adjacent to either one or both of the side frames 7 because the guide board mounting plates carrying the guide boards can be withdrawn from the machine as units in either the leftward or rightward direction, thereby permitting the machine to be compact in its entirety.. When the guide board mounting plates carrying guide boards which are exclusively utilized for a particular product preliminarily prepared, preparation time can be greatly shortened, thereby improving the efficiency of the machine. Further, as shown in FIG. 6, in case trouble happens such as the jamming of the raw material between the guide boards and the forming dies during the rolling forming operation, this present machine exhibits practical effectiveness that the jammed raw material W*x*, W*y* can be easily removed without removing the respective boards from the machine by merely withdrawing either ones of pins so as to shift the guide board mounting plates slightly to the left or the right.

Thus the described embodiment provides a device for holding raw material which avoids great difficulty in interchanging the guide boards, which is the disadvantage in the prior art device, and which makes it possible to repair and adjust the device easily without requiring the disassembly of the guide boards each time the jamming of the formed product and the raw material between the dies and the guide boards.

What we claim is:

1. In a cross-rolling machine, in which a raw material workpiece is forceably rotated by being held between two rolls rotatably mounted generally parallel to one another to extend transversally on a machine frame and which has forming dies on their radially outer peripheries which rollingly and deformingly contact the workpiece, a workpiece holding device, comprising:

guide track means extending longitudinally on the machine frame;

a pair of guide boards, including one arranged to be disposed forwardly of and the other arranged to be disposed behind the workpiece when said machine is in use;

frame assembly means including guide bar means each mounted for forward and rearward movement along said guide track means;

said guide boards being secured on said frame assembly means, so that the respective guide boards may be moved relative to the rolls by moving the respective guide bar means of the respective frame assembly means along the respective guide track means.

2. The cross-rolling machine workpiece holding device of claim 1, wherein:

the frame assembly is constituted by a unitary device and the guide bar means is constituted by respective guide bars for the respective guide boards.

3. The cross-rolling machine workpiece holding device of claim 1, wherein the guide track means comprises:

bracket means secured to the machine frame; and two transversally spaced sets of rollers rotatably mounted on the machine frame by said bracket means.

4. The cross-rolling machine workpiece holding device of claim 2, further including:

means for releasably holding the frame assembly fixed with respect to the machine frame, comprising:

means defining pin receiving recesses on the frame assembly;

respective pin means for receipt in said pin receiving recesses; and means securably and releasably mounting the pin means on the machine frame so that when the pin means are received in the respective pin receiving recesses and are secured to the machine frame movement of the frame assembly along the guide track means is restricted, and so that when the pin means are released from the machine frame and are withdrawn from the respective pin receiving recesses, movement of the frame assembly along the guide track means is made possible.

5. The cross-rolling machine workpiece holding device of claim 4, wherein:

the pin receiving recess means includes at least one forwardly opening recess positioned forwardly on the frame assembly and at least one rearwardly opening recess positioned rearwardly on the frame assembly;

the pin means includes at least one pin mounted to seat in the forwardly open recess and at when both pins are received in the respective recesses, the frame assembly is restricted against movement both forwardly and rearwardly, when both pins are withdrawn from the respective recesses, the frame assembly is freed to move both forwardly and rearwardly, when said one pin is received in the respective recess while said other pin is withdrawn from the respective recess, the frame assembly is freed to move forwardly and to return, but restricted against moving further rearwardly, and when said other pin is received in the respective recess while said one pin is withdrawn from the respective recess, the frame assembly is freed to move rearwardly and to return, but restricted against moving further forwardly.

6. The cross-rolling machine workpiece holding device of claim 5, wherein:

at least one of said one pin and said other pin is tapered and the respective recess therefore is correspondingly tapered, to permit slightly decreasing restriction of the frame assembly against movement by partial withdrawal of the tapered pin.

7. The cross-rolling machine workpiece holding device of claim 5, wherein:

one of said guide bars longitudinally extending along the left of the frame assembly, the other of said guide bars longitudinally extending along the right of the frame assembly;

one guide board mounting plate extending transversally between the two guide bars at the front of the frame assembly, another guide board mounting plate extending transversally between the two guide bars at the rear of the frame assembly;

each guide board having a base mounted on a respective guide board mounting plate; and block means provided on the respective guide board mounting plates, the block means bearing the respective recesses for receiving the respective pins.

* * * * *